US009883775B1

(12) United States Patent
Molezion

(10) Patent No.: US 9,883,775 B1
(45) Date of Patent: Feb. 6, 2018

(54) BEARD-GROOMING CLEAN UP SHEETS

(71) Applicant: Danny Molezion, Alphharetta, GA (US)

(72) Inventor: Danny Molezion, Alphharetta, GA (US)

( * ) Notice: Subject to any disclaimer, the term of this patent is extended or adjusted under 35 U.S.C. 154(b) by 23 days.

(21) Appl. No.: 15/181,493

(22) Filed: Jun. 14, 2016

Related U.S. Application Data

(60) Provisional application No. 62/184,856, filed on Jun. 26, 2015.

(51) Int. Cl.
*A47K 1/06* (2006.01)
*A45D 27/00* (2006.01)

(52) U.S. Cl.
CPC ..... *A47K 1/06* (2013.01); *A45D 27/00* (2013.01)

(58) Field of Classification Search
CPC ..... A47K 1/06; A45D 27/00
USPC ..... 4/655
See application file for complete search history.

(56) References Cited

U.S. PATENT DOCUMENTS

| | | | | |
|---|---|---|---|---|
| 1,703,053 A | | 2/1929 | Belles | |
| 2,817,851 A | * | 12/1957 | Barnwell | A47K 1/06 4/655 |
| 5,216,764 A | | 6/1993 | Hall | |
| 5,862,535 A | | 1/1999 | Noga | |
| 5,991,942 A | | 11/1999 | Neal | |
| 7,685,654 B1 | | 3/2010 | Jones | |
| D631,952 S | | 2/2011 | Marcoff | |
| 7,951,292 B1 | | 5/2011 | de la Torre | |
| 9,080,322 B1 | | 7/2015 | Rodrigues | |
| D761,403 S | * | 7/2016 | Molezion | D23/308 |
| D762,828 S | * | 8/2016 | Nolen | D23/308 |
| 2007/0180610 A1 | | 8/2007 | Mohr | |
| 2008/0201840 A1 | | 8/2008 | Hill | |
| 2010/0325791 A1 | | 12/2010 | Davidowitz | |
| 2016/0032573 A1 | | 2/2016 | Gavin | |

FOREIGN PATENT DOCUMENTS

FR 2900559 A1 6/2014

* cited by examiner

*Primary Examiner* — Huyen Le

(57) ABSTRACT

The beard-grooming clean up sheets involves a sheet member with a domed recess thereon. The domed recess is adapted to be positioned over a faucet of a sink in order to divert hair trimmings associated with personal grooming away from the faucet. Moreover, the domed recess is an adjunct of the sheet member. The sheet member is generally planar, and is adapted to be draped over the sink. Both the domed recess and the sheet member are surrounded with a plurality of sheet armatures that span outwardly with respect to the domed recess and the sheet member. The plurality of sheet armatures are adapted to engage counter surfaces surrounding the faucet and the sink. Moreover, adhering members is provided on a bottom surface of two opposing ones of the plurality of sheet armatures. The adhering members is adapted to temporarily secure the sheet member in place.

4 Claims, 4 Drawing Sheets

BEARD-GROOMING CLEAN UP SHEETS

CROSS REFERENCES TO RELATED APPLICATIONS

This non-provisional patent application claims priority to a provisional patent application 62/184,856 that was filed on Jun. 26, 2015.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of accessories that aid in cleaning up hair trimmings in and around a sink and applicable counter area, more specifically, a sheet that is specially adapted for use with a sink and surrounding areas in order to collect hair trimmings from grooming.

SUMMARY OF INVENTION

The beard-grooming clean up sheets involves a sheet member with a domed recess thereon. The domed recess is adapted to be positioned over a faucet of a sink in order to divert hair trimmings associated with personal grooming away from the faucet. Moreover, the domed recess is an adjunct of the sheet member. The sheet member is generally planar, and is adapted to be draped over the sink. Both the domed recess and the sheet member are surrounded with a plurality of sheet armatures that span outwardly with respect to the domed recess and the sheet member. The plurality of sheet armatures are adapted to engage counter surfaces surrounding the faucet and the sink. Moreover, adhering members is provided on a bottom surface of two opposing ones of the plurality of sheet armatures. The adhering members is adapted to temporarily secure the sheet member in place.

These together with additional objects, features and advantages of the beard-grooming clean up sheets will be readily apparent to those of ordinary skill in the art upon reading the following detailed description of the presently preferred, but nonetheless illustrative, embodiments when taken in conjunction with the accompanying drawings.

In this respect, before explaining the current embodiments of the beard-grooming clean up sheets in detail, it is to be understood that the beard-grooming clean up sheets is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the beard-grooming clean up sheets.

It is therefore important that the claims be regarded as including such equivalent construction insofar as they do not depart from the spirit and scope of the beard-grooming clean up sheets. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
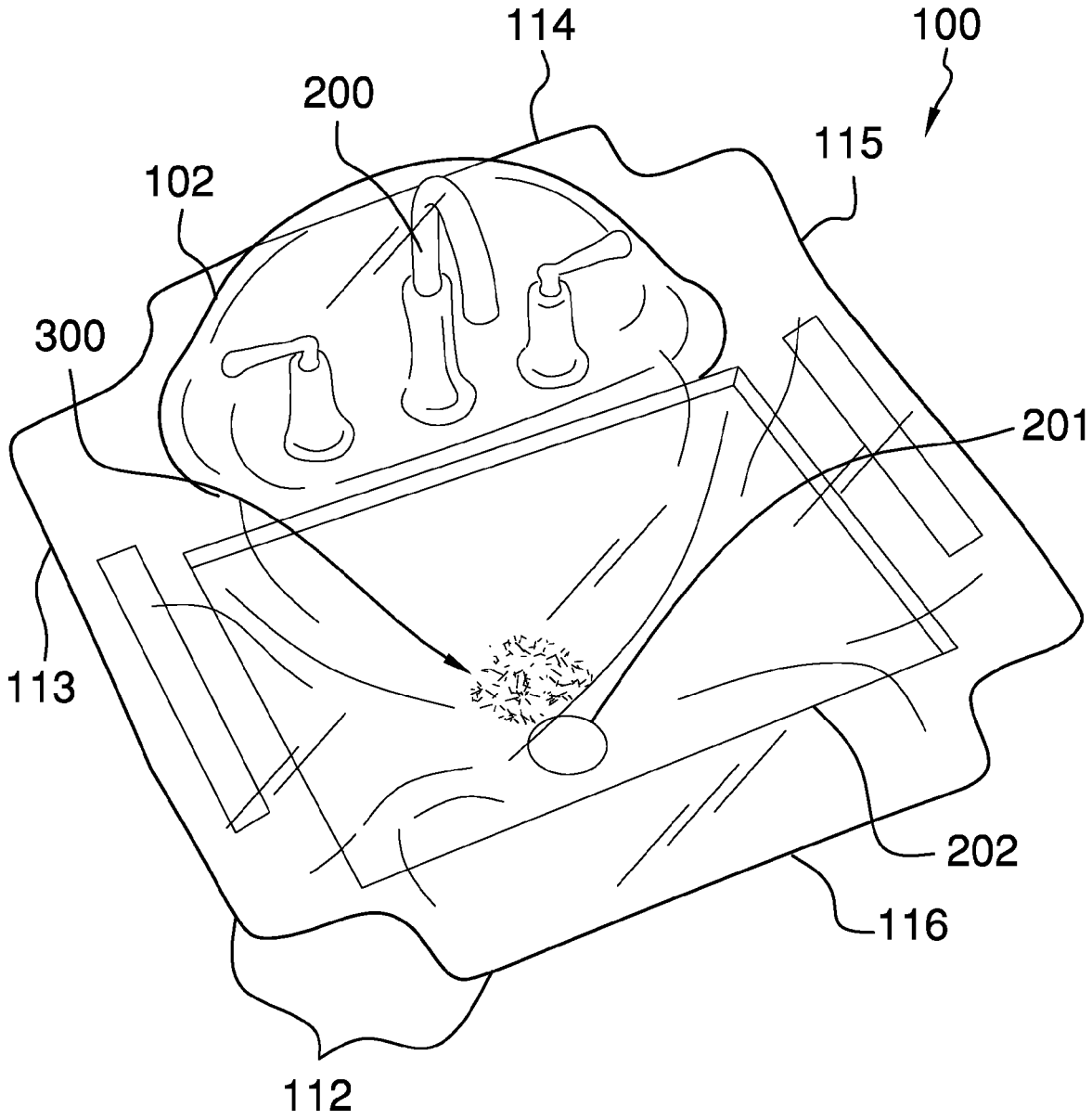
FIG. 1 is a perspective view of an embodiment of the disclosure.
Figure 2:
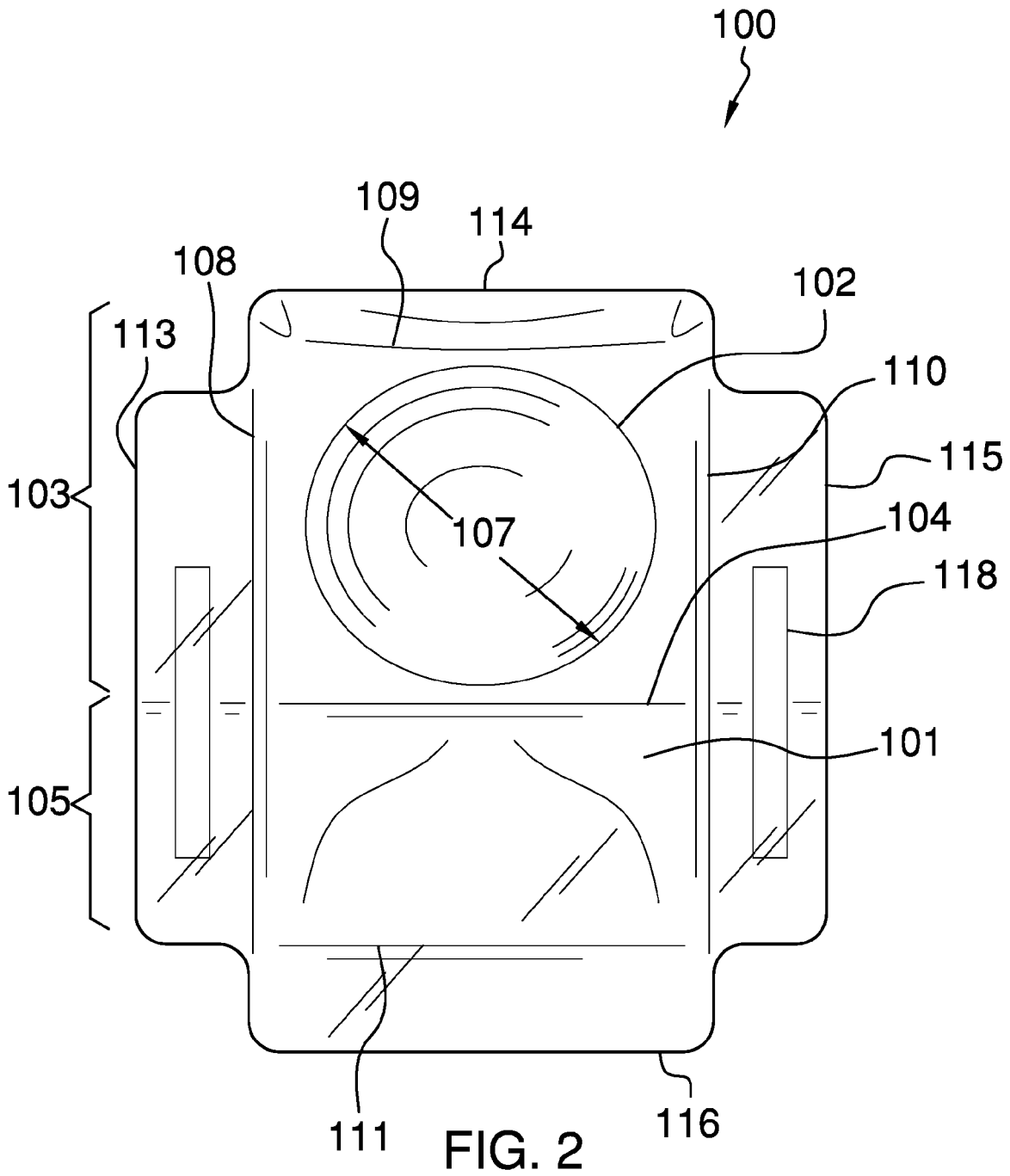
FIG. 2 is a perspective view of an embodiment of the disclosure.
Figure 3:
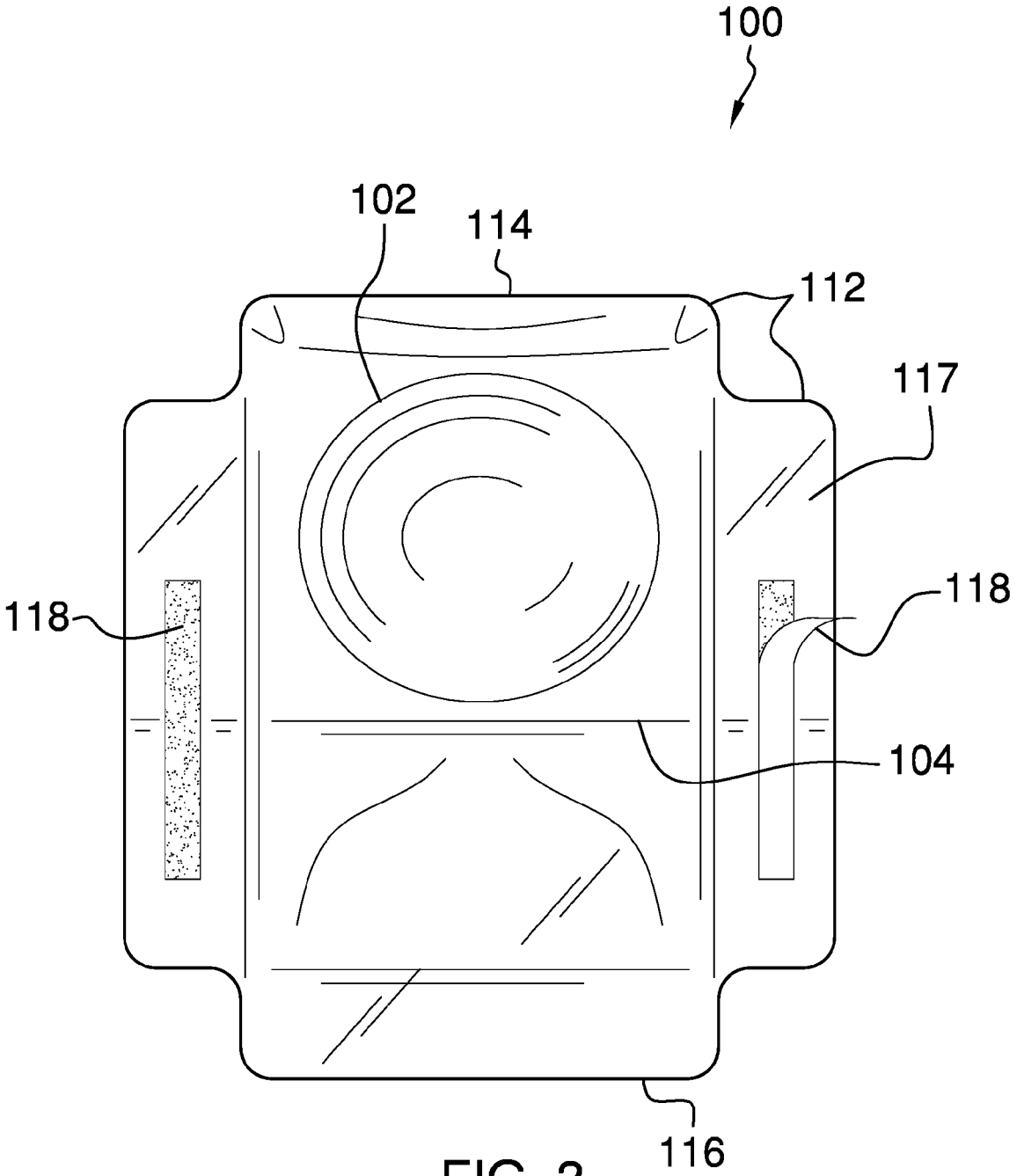
FIG. 3 is a cross-sectional view of an embodiment of the disclosure across 3-3 as shown in FIG. 2.
Figure 4:
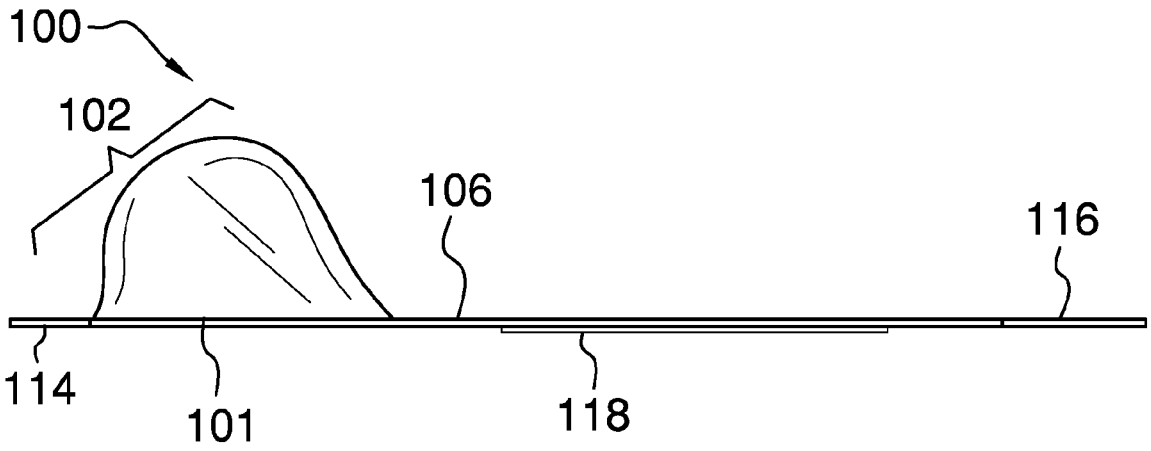
FIG. 4 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The beard-grooming clean up sheets 100 (hereinafter invention) comprises a sheet member 101 that is generally planar and includes a domed recess 102 thereon. The sheet member 101 is a generally rectangular planar body with a forward half 103 containing the domed recess 102 thereon. The sheet member 101 is further defined with a horizontal line 104, which separates the forward half 103 from a rearward half 105.

It shall be noted that the domed recess 102 extends vertically with respect to a top surface 106 of the sheet member 101. The domed recess 102 has a diameter 107 that is adapted to correlate with a faucet 200. The domed recess 102 is adapted to be placed over the faucet 200 while the rearward half 105 of the sheet member 101 is adapted to be draped over a sink 201 that correlates with the faucet 200. The domed recess 102 and the sheet member 101 are adapted to receive hair trimmings 300 that are associated with personal grooming.

The sheet member 101 is further defined with a first edge 108, a second edge 109, a third edge 110, and a fourth edge 111. The first edge 108 is opposite the third edge 110. The second edge 109 is opposite the fourth edge 111. The second edge 108 is adjacent to the domed recess 102; whereas the fourth edge 111 defines the limit of the rearward half 105. The first edge 108, the third edge 110, and the fourth edge 111 are adapted to be adjacent to the sink 201. The second edge 109 is adapted to be positioned behind the faucet 200.

The sheet member 101 and the domed recess 102 are surrounded by a plurality of sheet armatures 112. The plurality of sheet armatures 112 are adapted to be used to further secure the invention 100 onto a supporting surface 202. It shall be noted that the term supporting surface 202 is being used to refer to a counter that may surround the sink 201 and the faucet 200. The plurality of sheet armatures 112 is further defined with a first armature 113, a second armature 114, a third armature 115, and a fourth armature 116.

The first armature 113 touches and extends outwardly with respect to the first edge 108. The second armature 114 touches and extends outwardly with respect to the second edge 109. The third armature 115 touches and extends outwardly with respect to the third edge 110. The fourth armature 116 touches and extends outwardly with respect to the fourth edge 111. The overall shape of the invention 100 when viewed from above resembles a "+" shaped sign. The first armature 113 is parallel with and opposite of the third armature 115. The second armature 114 is parallel with and opposite of the fourth armature 116.

The plurality of sheet armatures 112 is further defined with a bottom armature surface 117. The bottom armature surface 117 is adapted to interface with the supporting surface 202. Moreover, the first armature 113 and the third armature 115 each include an adhering member 118 that is used to further secure the invention 100 over the sink 201 and the supporting surface 202. The adhering member 118 is a glorified term for a strip of adhesive. The adhering member 118 may include a removable wax paper strip 119 that is peeled off prior to securing the invention 100 onto the supporting surface 202.

Figure 5:
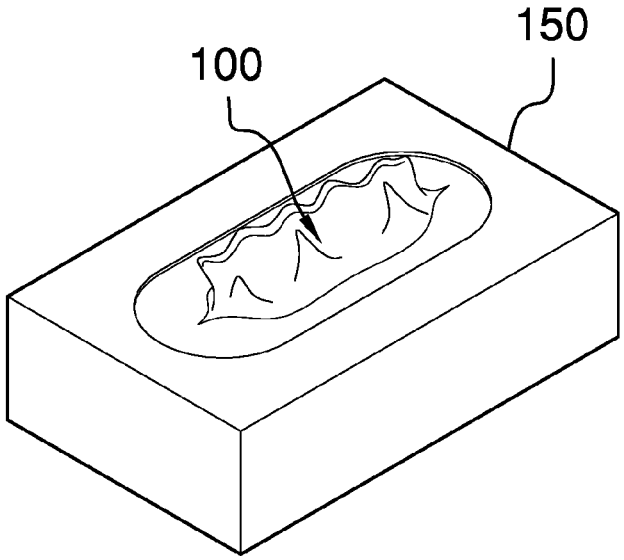
FIG. 5 is a side view of an embodiment of the disclosure.

The sheet member 101 and the plurality of armatures 112 may be constructed of a plastic sheeting or paper. After use, the invention 100 is simply detached from the supporting surface 202, and the sheet member 101 is folded over onto itself, and collecting hair trimmings 300 collected thereon. The invention 100 may then be discarded or cleaned for subsequent uses. It shall be noted that the invention 100 may be reusable or designated as a single use product. Referring to FIG. 5, the invention 100 may come in a box 150 with a plurality of disposables included therein.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for collecting hair trimmings while grooming comprising:

a sheet member that is adapted to be draped over a faucet and a sink in order to collect said hair trimmings;

wherein the sheet member is generally planar and includes a domed recess thereon;

wherein the sheet member is a generally rectangular planar body with a forward half containing the domed recess thereon;

wherein the sheet member is further defined with a horizontal line, which separates the forward half from a rearward half;

wherein the domed recess extends vertically with respect to a top surface of the sheet member;

wherein the domed recess has a diameter that is adapted to correlate with the faucet;

wherein the domed recess is adapted to be placed over the faucet while the rearward half of the sheet member is adapted to be draped over the sink that correlates with the faucet;

wherein both the domed recess and the sheet member are adapted to receive said hair trimmings that are associated with personal grooming;

wherein the sheet member is further defined with a first edge, a second edge, a third edge, and a fourth edge;

wherein the first edge is opposite the third edge;

wherein the second edge is opposite the fourth edge;

wherein the second edge is adjacent to the domed recess;

whereas the fourth edge defines the limit of the rearward half;

wherein the first edge, the third edge, and the fourth edge are adapted to be adjacent to the sink;

wherein the second edge is adapted to be positioned behind the faucet;

wherein the sheet member and the domed recess are surrounded by a plurality of sheet armatures;

wherein the plurality of sheet armatures are adapted to be used to further secure the accessory onto a supporting surface;

wherein the plurality of sheet armatures is further defined with a first armature, a second armature, a third armature, and a fourth armature;

wherein the first armature touches and extends outwardly with respect to the first edge;

wherein the second armature touches and extends outwardly with respect to the second edge;

wherein the third armature touches and extends outwardly with respect to the third edge;

wherein the fourth armature touches and extends outwardly with respect to the fourth edge;

wherein the accessory has an overall shape when viewed from above resembles a "+" shaped sign.

2. The accessory according to claim 1 wherein the first armature is parallel with and opposite of the third armature; wherein the second armature is parallel with and opposite of the fourth armature.

3. The accessory according to claim 2 wherein the plurality of sheet armatures is further defined with a bottom armature surface; wherein the bottom armature surface is adapted to interface with the supporting surface.

4. The accessory according to claim 3 wherein the first armature and the third armature each include an adhering member that is used to further secure the accessory over the sink and the supporting surface; wherein the adhering member includes a removable wax paper strip that is peeled off prior to securing the accessory onto the supporting surface.

* * * * *